US006665513B2

(12) United States Patent
Katoh

(10) Patent No.: US 6,665,513 B2
(45) Date of Patent: Dec. 16, 2003

(54) IMAGE FORMING APPARATUS INCLUDING A CLEANING SHEET FOR CLEANING A PERIPHERAL SURFACE OF A HEAT ROLLER

(75) Inventor: Tetsuo Katoh, Kunitachi (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/126,897

(22) Filed: Apr. 22, 2002

(65) Prior Publication Data

US 2002/0154926 A1 Oct. 24, 2002

(30) Foreign Application Priority Data

Apr. 23, 2001 (JP) ..... 2001-125139

(51) Int. Cl.[7] ..... G03G 15/20
(52) U.S. Cl. ..... 399/327
(58) Field of Search ..... 399/326, 327; 242/538, 538.1, 538.2

(56) References Cited

U.S. PATENT DOCUMENTS 5,168,314 A * 12/1992 Gunji et al. ..... 399/327
6,305,636 B1 * 10/2001 Satoh et al. ..... 242/538.2
6,532,353 B1 * 3/2003 Orchard et al. ..... 399/327

FOREIGN PATENT DOCUMENTS

JP 2000-267490 9/2000

* cited by examiner

*Primary Examiner*—William J. Royer
(74) *Attorney, Agent, or Firm*—Foley & Lardner

(57) ABSTRACT

A fixing device is disclosed which includes a heat roller and a press roller through which an image recording medium carrying thereon a toner image is passed for fixing the toner image to the image recording medium. The fixing device further includes a sheet supply shaft carrying thereon a roll of cleaning sheet in the form of a web, a sheet winding shaft for winding thereon the cleaning sheet, and a motor for controllably driving the sheet winding shaft, the cleaning sheet being pressed against the heat roller for cleaning the peripheral surface thereof while being wound on the sheet winding shaft. The cleaning sheet is provided on one surface thereof with a pattern of markings, such as graduations, which is detectable by an optical sensor. The current speed of movement of the cleaning sheet is calculated by a speed calculator based on detection signals from the optical sensor. A speed of rotation of the motor is controlled so that the current sheet speed becomes a predetermined target speed.

10 Claims, 3 Drawing Sheets

IMAGE FORMING APPARATUS INCLUDING A CLEANING SHEET FOR CLEANING A PERIPHERAL SURFACE OF A HEAT ROLLER

BACKGROUND OF THE INVENTION

1. Field of the Invention

The present invention relates to a fuser or a fixing device for use in an image forming apparatus such as copier and the like. More specifically, the present invention relates to a fixing device of the type wherein an image recording medium such as a sheet of paper having formed thereon a toner image is passed under pressure through a nip formed between a heat roller and a press roller of the fixing device to fix the toner image to the image recording medium, and wherein a cleaning sheet in the form of a web unwound from a sheet supply shaft is pressed against the peripheral surface of the heat roller for cleaning that surface while being wound on a sheet winding shaft driven by a motor. Furthermore, the invention relates to the cleaning sheet per se and also to an image forming apparatus equipped with the above fixing device.

2. Description of the Related Art

In a conventional fixing device of the above described type having a sheet supply shaft carrying thereon a roll of cleaning sheet in the form of a web and a sheet winding shaft for winding thereround the cleaning sheet, part of the cleaning sheet withdrawn from the supply shaft and then moving between the sheet supply and winding shafts is pressed against the heat roller of the fixing device to clean the surface of the heat roller while the sheet is being taken up by the winding shaft. In such an arrangement, it is necessary for the cleaning sheet passing between the heat and press rollers to move at a constant speed. Since the diameter of the cleaning sheet being wound on the sheet winding shaft is increased with the progress of sheet winding operation, it is necessary that the speed of the motor for driving the sheet winding shaft is slowed down in response to an increase in the wound diameter so that the speed of the cleaning sheet moving past the heat roller is maintained constant. For this purpose, a web counter for detecting the rotational speed of the motor has been provided. Since the amount of cleaning sheet wound around the winding shaft increases in proportion to the number of image recording paper sheets which have passed through the fixing device, i.e. the number of prints, the rotational speed of the motor has been controlled heretofore in response to an increase in the number of prints so that the speed at which the cleaning sheet is conveyed through the heat and press rollers is maintained constant. A manner of controlling the motor speed in response to an increasing number of prints is shown in FIG. 4.

In the above arrangement wherein the motor speed is controlled according to the curve shown in FIG. 4, the web counter must be reset to zero when a roll of cleaning sheet is replaced with a new one. If the cleaning sheet must be removed for some reason before it is used up and then replaced in the fixing device, however, information about the amount or the length of the cleaning sheet which had been used until it was removed is lost and, therefore, re-setting of the web counter cannot be made, with the result that the whole cleaning sheet must be replaced with a new roll of cleaning sheet. Additionally, the use of a cleaning sheet with a different thickness will pose an inconvenience in that the control curve as exemplified in FIG. 4 need be modified or changed to the one which suits the cleaning sheet with the new thickness.

A fixing device designed to solve the above-described drawbacks is disclosed in Japanese Patent Application KOKAI Publication No. 2000-267490. According to this proposed device, the sheet supply and winding shafts are supported in a slidable manner and there is provided a rotatable spiked wheel disposed so as to engage with the cleaning sheet adjacent to the sheet winding shaft while urging the winding shaft toward the sheet supply shaft. The rotatable spiked wheel drives the cleaning sheet to be wound round the winding shaft so that the cleaning sheet is conveyed at a constant speed. However, because the spiked wheel is rotated by a mechanical drive, which calls for a substantial space for installation thereof the proposed device is disadvantageous in terms of space factor, thereby making it difficult for the device to be constructed compact in size. If a fixing device operable according to the control curve shown in FIG. 4 is arranged in side-by-side relation to a fixing device using the above spiked wheel, there will arise an inconvenience that a cleaning sheet used only halfway in the fixing device having the spiked wheel cannot be used in the other fixing device.

SUMMARY OF THE INVENTION

The present invention has been made in light of the above-described problems and, therefore, has an object to provide a fixing device which can detect a speed of movement of a cleaning sheet with ease and with high accuracy without using any mechanical drive, thus making it possible to construct the fixing device small in size.

Further, an object of the present invention is to provide a cleaning sheet itself having on one surface thereof a pattern of markings to be detected for speed controlling.

Still another object of the invention is to provide an image forming apparatus using such fixing device and cleaning sheet.

For achieving the above objects, the present invention provides a cleaning sheet for use in a fixing device having a fixing heat roller and sheet supply or unwinding shaft and a winding shaft. In operation, the cleaning sheet unwound from the sheet supply shaft is placed in contact with the heat roller for cleaning the peripheral surface thereof while being wound on the sheet winding shaft. According to the invention, the fixing device has an optical sensor and the cleaning sheet is provided on one surface thereof with a pattern of markings which is detectable by the optical sensor in order that the speed at which the cleaning sheet is being moved is determined.

By providing such optical sensor and cleaning sheet, a speed of movement of the cleaning sheet can be directly detected with high accuracy and without calling for a complicated mechanical device.

According to the preferred embodiment of the present invention, the cleaning sheet is characterized in that the pattern of markings comprises graduations marked equidistantly along one lateral edge of the cleaning sheet.

The provision of such equidistantly-marked graduations on the cleaning sheet permits easy and accurate detection of the markings and hence of the speed of movement of the cleaning sheet.

According to the invention, part of the above graduations are marked with graduation numbers. Furthermore, the graduation numbers are provided in such a serial order that each graduation number indicates a position on the cleaning sheet which is locatable by counting from the first graduation number, e.g. zero. Still further, the graduation numbers are provided in increment of a predetermined value, e.g. 5, as 0, 5, 10, 15 and so forth.

Such graduations and their numbers on the cleaning sheet serve to provide information helpful to make sure of about what extent the cleaning sheet has been used by having reference to the graduation numbers and, therefore, such cleaning sheet is applicable easily to a fixing device which needs re-setting of a web counter depending on the amount of the web which has been already used for cleaning. The use of the optical sensor in conjunction with the cleaning sheet having the equidistantly-marked graduations can make possible easy adjustment of the sheet moving speed so that it is maintained substantially constant by controlling such that the rate of reading the graduation by the optical sensor is constant. Furthermore, the provision of the graduation numbers in increment of a predetermined value not only permits easy recognition of the used amount of the cleaning sheet, but also obviates the trouble of marking each graduation with its own number.

The present invention further provides a fixing device comprising a fixing heat roller for fixing a toner image carried on an image recording medium, a press roller for pressing the image recording medium against the heat roller, a cleaning mechanism which includes a sheet supply shaft carrying thereon a roll of the cleaning sheet in the form of a web and a sheet winding shaft for winding thereon the cleaning sheet, wherein the cleaning sheet is pressed against the heat roller for cleaning the peripheral surface thereof while being wound on the sheet winding shaft. According to the invention, the fixing device further comprises a speed detector for optically detecting the speed of movement of the cleaning sheet which is being fed to be wound on the winding shaft, and a speed control device for controlling the speed of winding of the cleaning sheet based on the sheet moving speed detected by the speed detector.

With the fixing device thus constructed, the speed of movement of the cleaning sheet can be directly detected with high accuracy without the need of a complicated mechanical device and it can be controlled with high accuracy, accordingly.

In the above fixing device, the cleaning sheet is provided on one surface thereof with a pattern of markings, and the speed detector comprises an optical sensor for optically detecting the pattern of markings to generate detection signals, and a speed calculator for calculating the speed of movement of the cleaning sheet based on the detection signals generated by the optical sensor.

By so constructing the fixing device, the speed at which the cleaning sheet is conveyed to be wound around the sheet winding shaft can be detected with ease and with high accuracy and, therefore, controlling of the speed can be accomplished with high accuracy, accordingly.

In the above fixing device, the pattern of markings comprises graduations, so that the information about the speed of movement of the cleaning sheet and the amount of the cleaning sheet which has been already used for cleaning can be obtained easily.

The fixing device according to the present invention further comprises a motor for controllably driving the sheet winding shaft, wherein the aforementioned speed control device is operable to control the speed of rotation of the motor so that the speed of movement of the cleaning sheet is maintained substantially at a predetermined value.

As result of such construction of the fixing device, the speed of movement of the cleaning sheet can be controlled with ease and with high accuracy.

The present invention also provides an image forming apparatus comprising: a fixing device including a heat roller and a press roller through which an image recording medium carrying thereon a toner image is passed for fixing said toner image to the image recording medium, said fixing device further including a sheet supply shaft carrying thereon a roll of cleaning sheet in the form of a web, a sheet winding shaft for winding thereon said cleaning sheet, and a motor for controllably driving said sheet winding shaft, said cleaning sheet being pressed against said heat roller for cleaning the peripheral surface thereof while being wound on said sheet winding shaft; said cleaning sheet being provided on one surface thereof with a pattern of markings; an optical sensor for optically detecting said pattern of markings on said cleaning sheet while said cleaning sheet is being moved to be wound on said sheet winding shaft, said optical sensor generating a detection signal when detecting each marking; and means for calculating an actual speed of movement of said cleaning sheet based on said detection signals from said optical sensor and for controlling a speed of rotation of said motor so that the calculated actual speed of movement of said cleaning sheet approaches a predetermined speed of movement.

In the image forming apparatus thus constructed, optically reading the markings on the cleaning sheet by the optical sensor makes possible direct and easy detection of the speed at which the cleaning sheet is moved to be wound on the winding shaft, which in turn permits easy and accurate controlling of the moving speed of the cleaning sheet.

BRIEF DESCRIPTION OF THE DRAWINGS

Other features and advantages of the present invention will become more apparent to those skilled in the art from the following description of preferred embodiments according to the invention with reference to the accompanying drawings, wherein.

DESCRIPTION OF THE PREFERRED EMBODIMENTS

Figure 1:
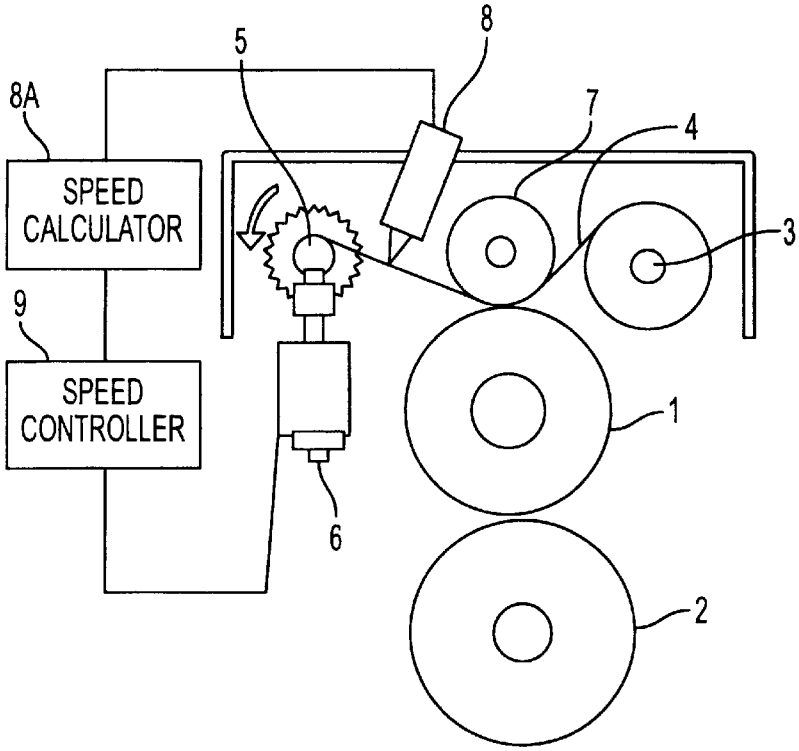
FIG. 1 is a schematic side elevation showing major relevant parts and elements of an image forming apparatus having a fixing device constructed according to the present invention.

Referring to FIG. 1, there is shown a fuser or a fixing device for use in an image forming apparatus according to a preferred embodiment of the present invention. The fixing device includes a heat roller 1 and a press roller 2 disposed one above the other with the axes thereof extending in parallel to each other, between which an image recording medium such as a sheet of paper (not shown) carrying thereon a toner image is passed thereby to fix the toner image to the paper sheet in a known manner. The fixing device has, in a cleaning sheet supply station thereof, a rotary sheet supply shaft 3 carrying therearound a roll of cleaning sheet 4, and a sheet take-up or winding shaft 5 for winding thereon the cleaning sheet 4, which is unwound from the sheet supply shaft 3 and moved past between the heat roller 1 and a sheet press roller 7. The sheet press roller 7 is urged so as to press the cleaning sheet 4 against the heat roller 1. The sheet winding shaft 5 is operatively connected to a motor 6 to be controllably driven thereby as will, be described more in detail later.

Figure 2:
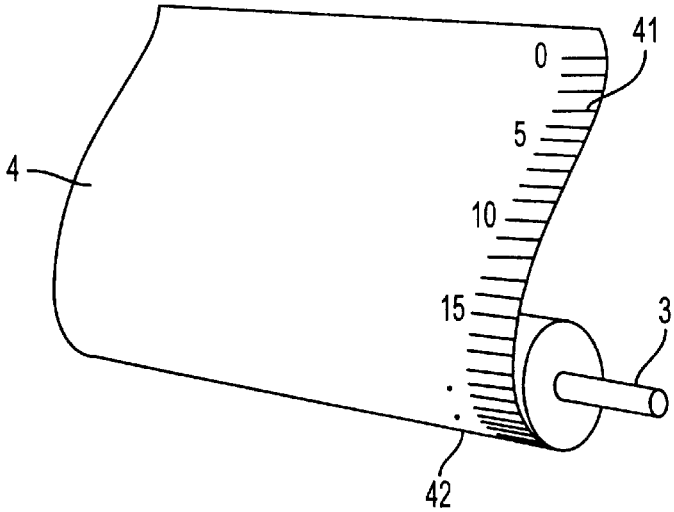
FIG. 2 is a perspective view showing a roll of cleaning sheet in the form of a web adapted for use in the fixing device of FIG. 1 according to a preferred embodiment of the present invention.

Referring now to FIG. 2 showing in perspective view the roll of cleaning sheet 4 on the sheet supply shaft 3 before it is installed in the fixing device, the cleaning sheet 4 wound around the sheet supply shaft 3 has graduations 41 marked equidistantly on one surface, facing outside as viewed from the sheet supply shaft 3, of one lateral edge portion thereof. In the illustrated embodiment, the graduations 41 are provided by straight lines of the same length extending perpendicularly to the direction in which the cleaning sheet 4 is fed from the sheet supply shaft 3 to the sheet winding shaft 5. As shown in FIG. 2, part of the graduations 41 are provided with graduation numbers 42 beside the graduation markings 41 in increment of 5 starting from "0", i.e. 0, 5, 10, 15 and so forth. It is noted that the arrangement of the graduations 41 is merely an example and, therefore, the markings may be provided in any other forms as long as they can be located or detected easily by a sensor which will be described later and also that the graduation number 42 may be marked in any other forms than that illustrated in FIG. 2.

The sheet press roller 7, located between the sheet supply shaft 3 and the sheet winding shaft 5, is adapted to press the cleaning sheet 4 against the peripheral surface of the heat roller 1 as shown in FIG. 1 for cleaning stains or contaminants and any other possible foreign matters from the peripheral surface of the heat roller 1 in a manner known in the art. An optical sensor 8 is provided between the sheet press roller 7 and the sheet winding shaft 5 at a position where the sensor 8 can read the graduations 41 on the cleaning sheet 4 which is being wound round the sheet winding shaft 5. That is, the optical sensor 8 is operable to count the number of the graduations 41 on the moving cleaning sheet 4 in a given length of time or, alternatively, the time before one graduation 41 is read after its preceding graduation 41 has been read. The optical sensor 8 is electrically connected to a speed calculator 8A which figures out the current or actual speed of movement of the cleaning sheet 4 on the basis of the information provided by the optical sensor 8. The output of the speed calculator 8A is electrically connected to a speed controller 9 which is in turn connected to the motor 6 for the sheet winding shaft 5. The speed controller 9 receives from the speed calculator SA the information of the current speed of movement of the cleaning sheet 4 and operates to control the rotational speed (rpm) of the motor 6 in such a way that the speed of movement of the cleaning sheet 4 falls within a predetermined permissible range. The optical sensor 8 and the speed calculator 8A constitute a speed detector in the fixing device of the present invention.

Figure 3:
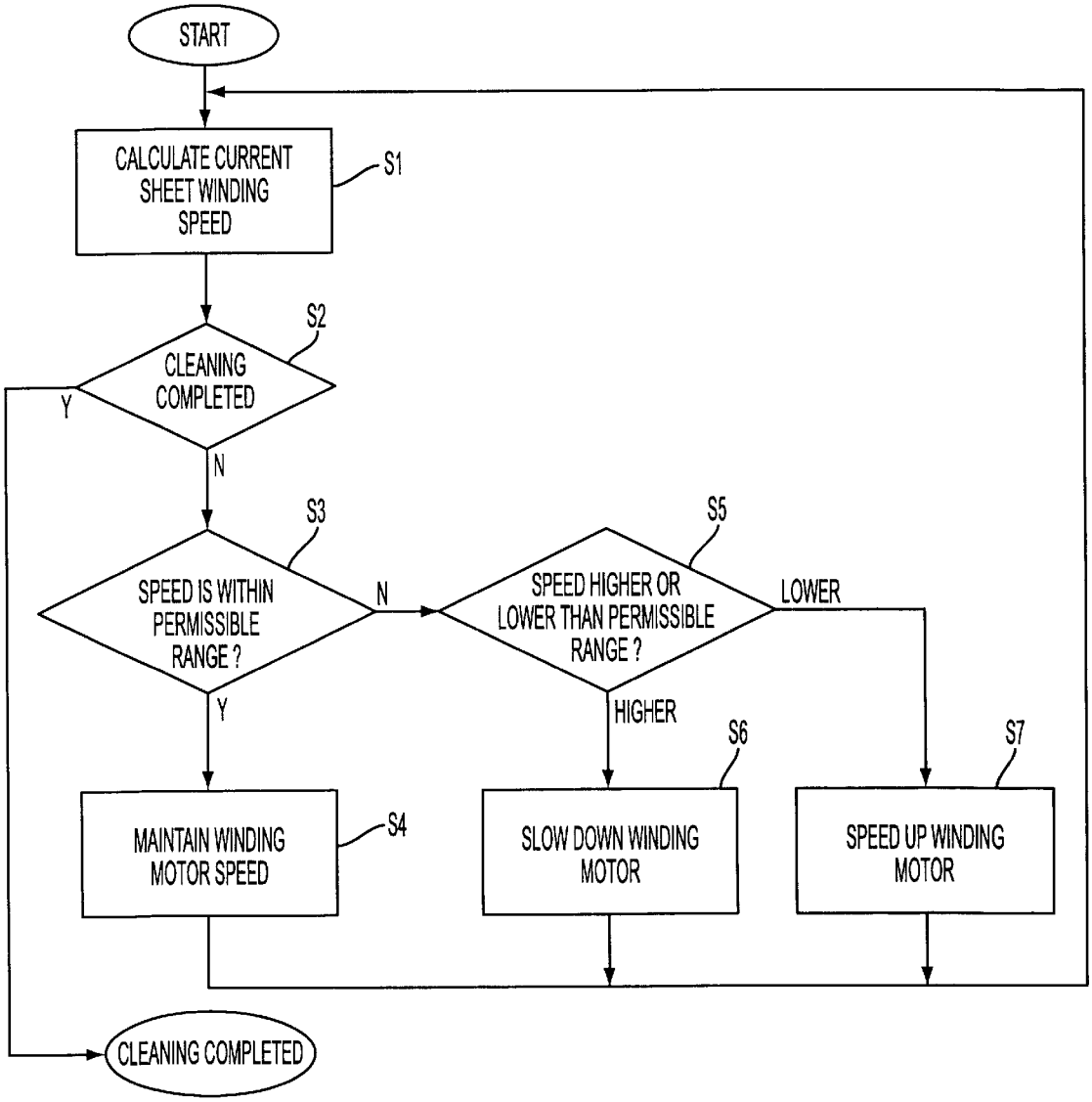
FIG. 3 is a flowchart illustrating a control action performed in the rotational speed controller shown in FIG. 1.

The following will describe more in detail the manner in which the motor 6 is controlled by the speed controller 9, with reference to the flow chart of FIG. 3. At a first step S1, the speed controller 9 figures out the current take-up or winding speed of the cleaning sheet 4 from the information supplied by the optical sensor 8. At a next step S2, it is determined whether or not a signal is generated which commands the completion of cleaning operation. If the command signal is present, the cleaning operation is completed. If not, it is determined at a step S3 whether or not the speed calculated at step S1 is within the predetermined permissible range. If the take-up speed is found to fall within the permissible range, the current speed of the motor 6 is maintained as it is as indicated at a step S4 and is returned to step S1. In the event that the current sheet take-up speed is found outside the permissible range at step S3, it is then determined at step S5 whether the speed is hither or lower the permissible range. If high, the motor 6 is slowed down at a step S6 and is returned to step S1. If the speed is lower than the permissible range, on the other hand, the motor 6 is speeded up at a step S7 and is returned to step S1. Thus, the speed of the cleaning sheet 4 moving past the heat roller 1 of the fixing device is maintained within the predetermined permissible range irrespective of the wound diameter of the cleaning sheet 4 on the sheet winding shaft 5.

Figure 4:
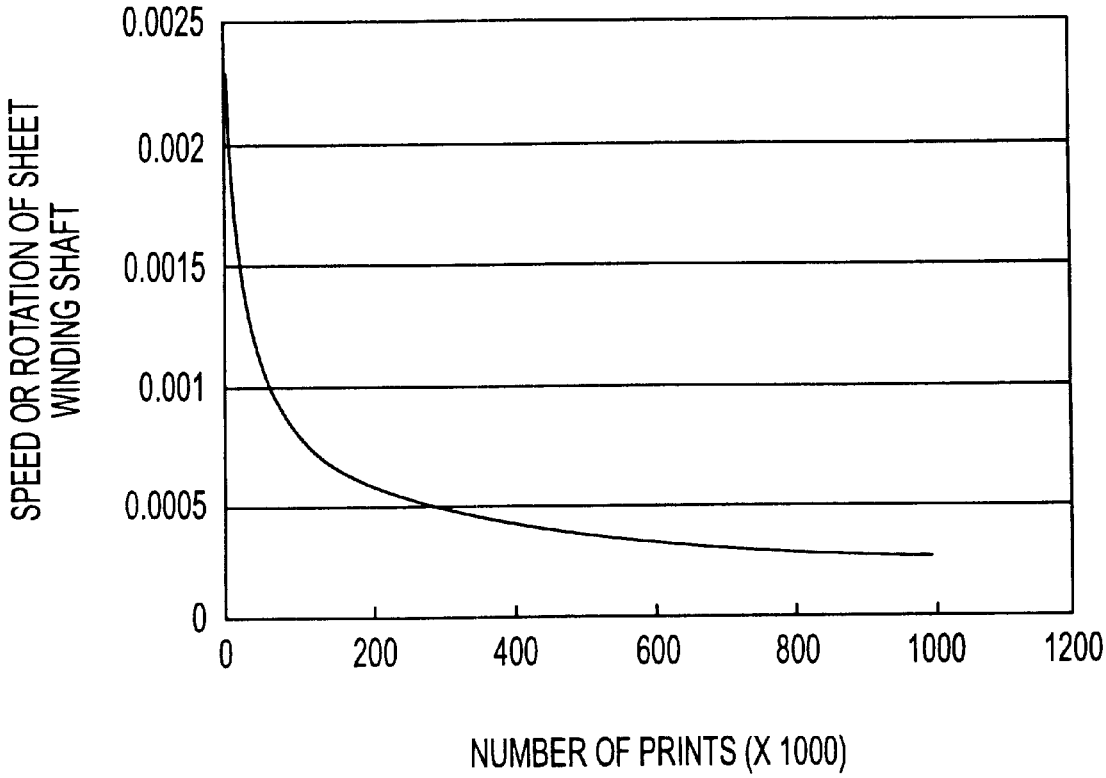
FIG. 4 (PRIOR ART)
FIG. 4 is a graph showing a control curve as an example used in a conventional fixing device for controlling the rotational speed of a cleaning sheet winding shaft with the number of prints as a function.

As described earlier with reference to FIG. 2, the cleaning sheet 4 is provided, for example by printing, not only with the graduations 41 adjacent to one lateral edge of the cleaning sheet 4 which are used for the subsequent control of the winding speed of the cleaning sheet 4, but also a series of graduation numbers 42 in increments of five starting from zero, each indicating its corresponding position on the cleaning sheet 4. By so adding the graduation numbers 42, even if the cleaning sheet 4 is removed from the fixing device and then replaced in the device (e.g., after a work has been completed which needed the removal of the cleaning sheet 4), the length of the cleaning sheet 4 which has been used for cleaning of the heat roller 1 can be known by having reference to the graduation numbers 42 on the cleaning sheet 4. If such cleaning sheet 4 is in the conventional fixing device described with reference to FIG. 4, re-setting of the cleaning web counter can be performed with ease. As a matter of fact, the cleaning sheet 4 shown in FIG. 2 is applicable to the aforementioned prior art fixing device which uses a spiked wheel. The cleaning sheet 4, which is thus applicable to various types of fixing devices, can contribute to ease of handling the cleaning sheet 4 in such fixing devices.

As apparent from the foregoing, the exemplary cleaning sheet 4 provided according to the present invention has on one surface thereof with a pattern of markings such as graduations 41 which are marked equidistantly along and adjacent to one lateral edge portion of the cleaning sheet 4, as well as the graduation numbers 42 provided in such a serial order that each graduation number 42 indicates a position on the cleaning sheet 4 which is locatable by counting from the first graduation number 42. In so providing the cleaning sheet 4, the graduation numbers 42 can serve to provide information helpful to ascertain to what extent the cleaning sheet 4 has been used and, therefore, such cleaning sheet 4 is applicable to a case in which the cleaning sheet 4 has been partially used for cleaning and a fixing device needs appropriate re-setting of its web counter depending on the used amount of the web. Furthermore, controlling the motor 6 in such a way that the graduations 41 on the cleaning sheet 4 are read at a constant rate can make it possible for the cleaning sheet 4 to move at a desired constant speed.

Furthermore, with the fixing device according to the present invention, optical means such as the optical sensor 8 detects the graduations 41 marked on the moving cleaning sheet 4, the speed calculator 8A then computes the current moving speed of the cleaning sheet 4 on the basis of the detection signal from the optical sensor 8, and the speed controller 9 connected to the motor 6 for the sheet winding shaft 5 compares the current speed with a predetermined target speed so that the motor 6 is controlled in such a way that the moving speed of the cleaning sheet 4 becomes substantially constant. Since electrical means are employed for controlling of the motor speed, the space required by such means can be reduced as compared with the prior art. If the cleaning sheet 4 is removed from the fixing device for some reason before the sheet is used up, the graduation number 42 marked on the cleaning sheet 4 can provide information regarding to what extent the cleaning sheet 4 has been used when it is removed. In a fixing device of the type in which a web counter must be re-set when cleaning sheet 4 once removed is replaced in the fixing device, such re-setting of the counter can be performed easily by using the cleaning sheet 4 of the present invention.

Thus, the use of the cleaning sheet 4 of the present invention can make possible easy and accurate detection of its moving speed without using mechanical devices, thus contributing compactness of a fixing device and hence an image forming apparatus having incorporated therein such fixing device.

While the invention has been described and illustrated with reference to the specific embodiment, it is to be understood that the invention can be practiced in other various changes and modifications without departing from the spirit or scope thereof.

What is claimed is:

1. A cleaning sheet for use in a fixing device having at least a heat roller and a sheet winding shaft, said cleaning sheet being wound on said sheet winding shaft at a predetermined speed while contacting with said heat roller for cleaning the peripheral surface thereof, wherein said cleaning sheet is provided at a predetermined region thereon with a pattern of markings that can be detected by an optical sensor to determine an actual speed of movement of said cleaning sheet.

2. A cleaning sheet according to claim 1, wherein said pattern of markings comprises graduations marked equidistantly along one lateral edge of said cleaning sheet.

3. A cleaning sheet according to claim 2, wherein at least selected ones of said graduations are marked with graduation numbers.

4. A cleaning sheet according to claim 3, wherein said graduation numbers are provided in such a serial order that each graduation number indicates a position on said cleaning sheet which is locatable by counting from a graduation.

5. A cleaning sheet according to claim 4, wherein said graduation numbers are provided in increments of a predetermined value.

6. A fixing device comprising:

a heat roller for heating a toner image formed on an image recording medium to fix the toner image thereto;

a press roller for pressing said image recording medium against said heat roller;

a cleaning mechanism including a sheet supply shaft carrying thereon a roll of cleaning sheet in the form of a web, and a sheet winding shaft for winding thereon said cleaning sheet, said cleaning sheet being pressed against said heat roller for cleaning the peripheral surface thereof while being wound on said sheet winding shaft;

a speed detector for optically detecting an actual speed of movement of said cleaning sheet being wound on said sheet winding shaft; and a speed control device for controlling a speed of winding of said cleaning sheet based on the detected actual speed of movement of said cleaning sheet detected by said speed detector.

7. A fixing device according to claim 6, wherein said cleaning sheet is provided with a pattern of markings, and wherein said speed detector includes an optical sensor for optically detecting said pattern of markings to generate a detection signal whenever said optical sensor detects each marking, and a speed calculator for calculating a speed of movement of said cleaning sheet based on said detection signals generated by said optical sensor.

8. A fixing device according to claim 7, wherein said pattern of markings comprises graduations, which are detected by said optical sensor.

9. A fixing device according to claim 6, further comprising a motor for controllably driving said sheet winding shaft, said speed control device controlling a speed of rotation of said motor so that the actual speed of movement of said cleaning sheet approaches a predetermined speed of movement.

10. An image forming apparatus comprising:

a fixing device including a heat roller and a press roller through which an image recording medium carrying thereon a toner image is passed for fixing said toner image to the image recording medium, said fixing device further including a sheet supply shaft carrying thereon a roll of cleaning sheet in the form of a web, a sheet winding shaft for winding thereon said cleaning sheet, and a motor for controllably driving said sheet winding shaft, said cleaning sheet being pressed against said heat roller for cleaning the peripheral surface thereof while being wound on said sheet winding shaft;

said cleaning sheet being provided on one surface thereof with a pattern of markings;

an optical sensor for optically detecting said pattern of markings on said cleaning sheet while said cleaning sheet is being moved to be wound on said sheet winding shaft, said optical sensor generating a detection signal when detecting each marking; and means for calculating an actual speed of movement of said cleaning sheet based on said detection signals from said optical sensor and for controlling a speed of rotation of said motor so that the calculated actual speed of movement of said cleaning sheet approaches a predetermined speed of movement.

* * * * *